US007753043B1

(12) United States Patent
Eckert

(10) Patent No.: US 7,753,043 B1
(45) Date of Patent: Jul. 13, 2010

(54) BOWSTRING RELEASE MOVABLE BETWEEN (AND FIXABLE INTO) STOWED AND SHOOTING POSITIONS

(75) Inventor: Jeffrey A. Eckert, North Fond du Lac, WI (US)

(73) Assignee: Tru-Fire Corporation, North Fond Du Lac, WI (US)

( * ) Notice: Subject to any disclaimer, the term of this patent is extended or adjusted under 35 U.S.C. 154(b) by 488 days.

(21) Appl. No.: 11/939,816

(22) Filed: Nov. 14, 2007

(51) Int. Cl.
*F41B 5/18* (2006.01)

(52) U.S. Cl. ..... 124/35.2

(58) Field of Classification Search ..... 124/35.2; 224/219, 267
See application file for complete search history.

(56) References Cited

U.S. PATENT DOCUMENTS

| | | | | |
|---|---|---|---|---|
| 4,509,497 | A | | 4/1985 | Garvison |
| 4,881,276 | A | | 11/1989 | Swan |
| 5,016,603 | A | | 5/1991 | Tentler |
| D320,254 | S | | 9/1991 | Peck |
| 5,067,472 | A | | 11/1991 | Vogel et al. |
| 5,070,854 | A | | 12/1991 | Peck |
| 5,076,251 | A | | 12/1991 | Peck |
| 5,078,116 | A | | 1/1992 | Peck |
| 5,103,796 | A | | 4/1992 | Peck |
| 5,170,771 | A | | 12/1992 | Peck |
| 5,261,581 | A | * | 11/1993 | Harden, Sr. ..... 224/219 |
| 5,263,466 | A | | 11/1993 | Peck |
| 5,307,788 | A | | 5/1994 | Peck |
| 5,318,004 | A | | 6/1994 | Peck |
| 5,323,754 | A | | 6/1994 | Pittman et al. |
| 5,357,939 | A | | 10/1994 | Tentler et al. |
| 5,359,983 | A | | 11/1994 | Peck |
| 5,370,102 | A | | 12/1994 | Peck |
| 5,394,639 | A | | 3/1995 | Tentler |
| 5,417,197 | A | | 5/1995 | Bankstahl |
| 5,558,077 | A | | 9/1996 | Linsmeyer |
| 5,564,407 | A | | 10/1996 | Linsmeyer |
| 5,582,158 | A | | 12/1996 | Linsmeyer |
| 5,595,167 | A | | 1/1997 | Scott |
| 5,615,662 | A | | 4/1997 | Tentler et al. |
| 5,653,213 | A | | 8/1997 | Linsmeyer |
| 5,680,852 | A | | 10/1997 | Tentler et al. |
| 5,845,628 | A | | 12/1998 | Pellerite |
| 5,850,827 | A | | 12/1998 | Peck |
| 5,857,452 | A | | 1/1999 | Troncoso |
| 5,937,841 | A | | 8/1999 | Summers et al. |
| 5,937,842 | A | | 8/1999 | Summers et al. |

(Continued)

*Primary Examiner*—John Ricci
(74) *Attorney, Agent, or Firm*—Craig A. Fieschko, Esq.; DeWitt Ross & Stevens S.C.

(57) ABSTRACT

An archery bowstring release includes a string grip for holding and releasing a bowstring, and a band for mounting the string grip about an archer's wrist or hand. The string grip may rotate about the band between an in-use position wherein the string grip is adjacent the archer's fingers, and a stowed position situated away from the archer's hand. This rotating arrangement is biased such that the string grip resists being situated in other than the in-use and stowed positions. Thus, the archer may "snap" the string grip into the in-use position when the string grip is desired for use in shooting, and may "snap" the string grip to the stowed position when the string grip is not needed. In this manner, the string grip does not interfere with use of the archer's hand when it is not in use.

25 Claims, 2 Drawing Sheets

U.S. PATENT DOCUMENTS

| | | | |
|---|---|---|---|
| 5,941,225 | A | 8/1999 | Tentler et al. |
| 5,944,004 | A | 8/1999 | Goff et al. |
| RE36,555 | E | 2/2000 | Tentler |
| 6,032,661 | A | 3/2000 | Goff et al. |
| 6,058,920 | A | 5/2000 | Tentler et al. |
| 6,125,833 | A | 10/2000 | Tentler et al. |
| 6,205,991 | B1 | 3/2001 | Summers et al. |
| 6,247,467 | B1 | 6/2001 | Siegfried |
| 6,253,753 | B1 | 7/2001 | Blum et al. |
| 6,302,093 | B1 | 10/2001 | Holland |
| 6,478,020 | B1 | 11/2002 | Rentz |
| 6,481,430 | B1 | 11/2002 | Lightcap, Jr. |
| 6,481,431 | B1 | 11/2002 | Summers |
| 6,484,710 | B1 | 11/2002 | Summers et al. |
| 6,571,786 | B2 | 6/2003 | Summers et al. |
| 6,584,966 | B1 | 7/2003 | Summers et al. |
| 6,606,984 | B2 | 8/2003 | Mugg |
| 6,631,709 | B2 | 10/2003 | Carter et al. |
| 6,712,060 | B2 | 3/2004 | Egusquiza |
| 6,763,819 | B2 | 7/2004 | Eckert |
| D501,908 | S | 2/2005 | Tentler |
| 6,925,996 | B1 | 8/2005 | Todd |
| RE38,833 | E | 10/2005 | Linsmeyer |
| 6,953,035 | B1 | 10/2005 | Summers et al. |
| 6,968,836 | B1 | 11/2005 | Kees |
| 7,240,672 | B2 | 7/2007 | Peck et al. |
| 7,278,415 | B2 | 10/2007 | Jones |
| 2009/0090341 | A1 | 4/2009 | Coughlin |

* cited by examiner

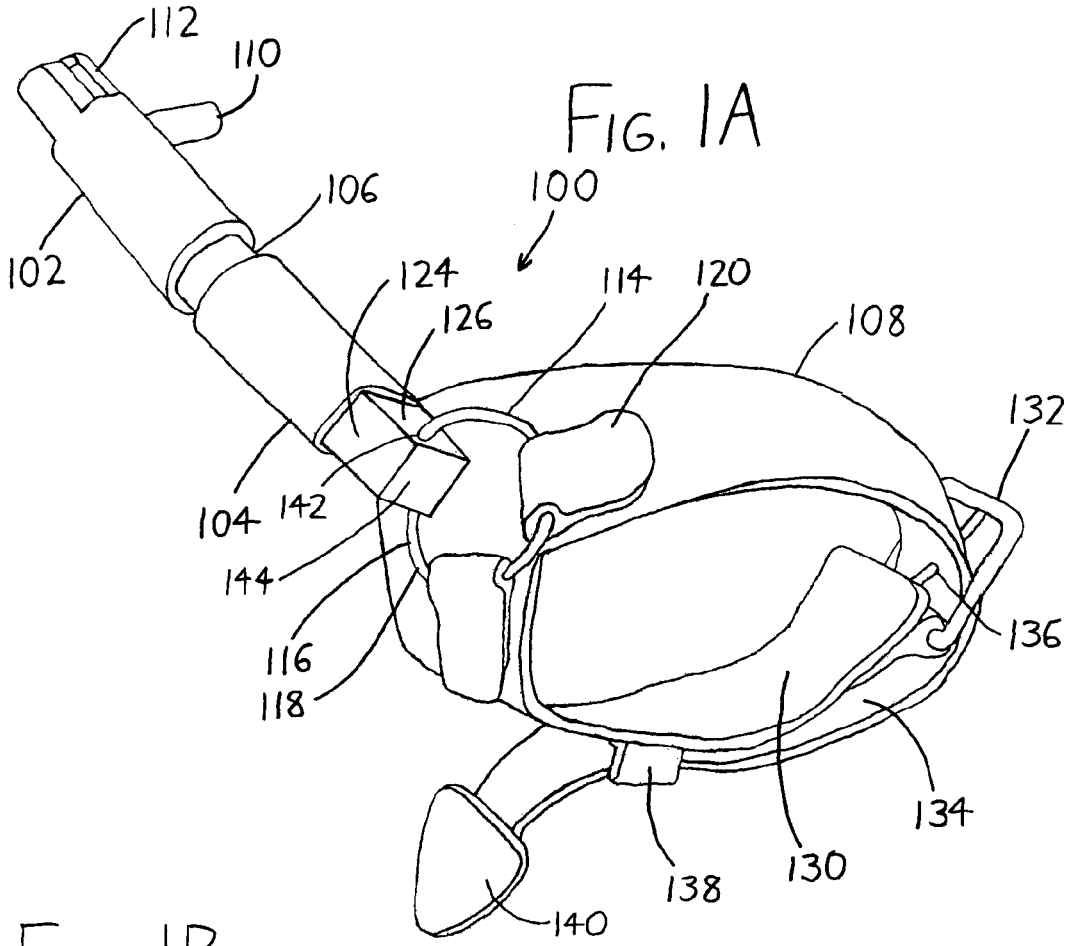
FIG. 1A
FIG. 1B
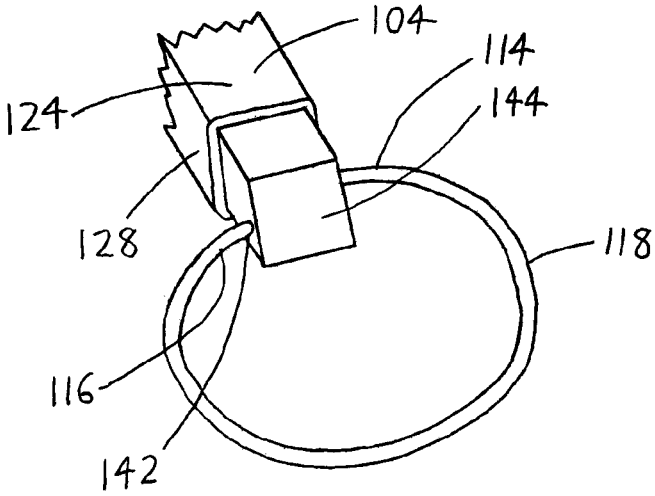

BOWSTRING RELEASE MOVABLE BETWEEN (AND FIXABLE INTO) STOWED AND SHOOTING POSITIONS

FIELD OF THE INVENTION

This document concerns an invention relating generally to bowstring releases for archers, and more specifically to bowstring releases which are worn by archers during use.

BACKGROUND OF THE INVENTION

Archery bowstring releases are devices which grasp the string of a bow, hold it for the archer as the archer prepares to launch the arrow, and then release the bowstring when desired by the archer. The archer therefore does not need to use his/her fingers to hold the bowstring, which can be uncomfortable. Additionally, arrow accuracy can be increased when an archer utilizes the more controlled and consistent release provided by a bowstring release. Bowstring releases are provided in a variety of different forms, with perhaps the most common form having a string grip—a device which grasps the bowstring via one or more jaws, hooks, loops, or other structure, and which may release the bowstring when the archer desires—which is worn on the archer's wrist or hand via a mounting band (i.e., a strap, belt, cord, or similar structure) affixed about the wrist or hand. The string grip is situated so that when the band is affixed about the archer's hand or wrist, the archer can actuate the string grip with his/her fingers to release a grasped bowstring when desired. Thus, an archer wears the bowstring release, and after nocking an arrow and placing the bowstring within the string grip, he/she pulls her hand back (thus pulling back the bowstring release and the arrow-carrying bowstring), and then actuates the string grip with his/her fingers to release the bowstring and arrow.

A problem with these and other bowstring releases is that the string grip may be conveniently situated for use when pulling and releasing the bowstring, but otherwise tends to get in the way of the archer's hand. For example, the string grip may project forwardly from the mounting band into the user's palm, or may simply dangle loosely from the mounting band. In either case, the string grip can interfere with the archer's activities, particularly while hunting.

One prior bowstring release developed by others had a string grip connected to a mounting band via a hinged grip mount (i.e., a hinged juncture between the mounting band and the string grip). The string grip freely swung about the mounting band, but also included a block on the mounting band which was made of a flexible elastomeric material such as rubber. A slot was formed in the block, with the slot's width enlarging as the depth of the slot extended into the block. With this arrangement, when an archer did not want the string grip dangling in the way of his/her fingers, he/she could swing it about the mounting band to insert it into the slot. The elastic block would then flex to receive and hold the grip mount. Thus, the archer could swing the string grip about the mounting band to stow the string grip away from his/her hand when desired.

The foregoing arrangement was a beneficial development because it offered a relatively simple, inexpensive, and compact arrangement for securing the string grip in a stowed position out of the archer's reach when the string grip was not in use. However, it suffered from the disadvantage that when the grip mount was not affixed within the block, the string grip could still flop around within the archer's reach. Ideally, the string grip would instead be fixed in a ready-to-shoot position within the reach of the archer's hand when it is not secured in the stowed position. However, the bowstring release could not readily be modified to (for example) add another slotted block for locking the string grip into the ready-to-shoot position, since this arrangement begins to add undesirable bulk (and stiffness) to the mounting band. Additionally, even if another slotted block is added, the string grip and its grip mount can still swing about the mounting band and interfere with the archer's activities when the string grip and grip mount are not fixed within one of the slotted blocks.

SUMMARY OF THE INVENTION

The invention involves a bowstring release which is intended to at least partially solve the aforementioned problems. To give the reader a basic understanding of some of the advantageous features of the invention, following is a brief summary of a preferred version of the release, with reference being made to the accompanying drawings to assist the reader's understanding. Since this is merely a summary, it should be understood that more details regarding the preferred version (and other versions) may be found in the Detailed Description set forth elsewhere in this document. The claims set forth at the end of this document then define the various versions of the invention in which exclusive rights are secured.

Looking to FIG. 1A, a preferred version 100 of the bowstring release is shown with a string grip 102 adapted to receive and release a bowstring, a grip mount 104 connected to the string grip 102 (preferably via a rotatable joint 106), and a band 108 suitable for fitting about a limb, with the grip mount 104 being pivotally connected to the band 108 (as will be discussed in greater detail below). FIG. 1A depicts the string grip 102 in a first (forward or ready-to-fire) grip mount position wherein a user may install his/her wrist within the band 108, with his/her index finger extended forwardly to actuate a trigger 110 and thereby release a bowstring from the string grip jaws 112. FIG. 2A, in contrast, depicts the string grip 102 in a second (retracted/stowed) grip mount position wherein the string grip 102 does not extend within the reach of the user's fingers, and does not interfere with the user's use of his/her hand. The grip mount 104 is preferably elastically biased into each of the first and second grip mount positions, whereby the grip mount 104, when urged out of one of the grip mount positions, is elastically biased toward the closer of the grip mount positions. Thus, the grip mount 104 and string grip 102 will "snap into" the first or second grip mount position as desired, without "flopping around" over the arc through which it pivots.

The foregoing arrangement can be achieved by providing a pair of mounting members 114 and 116—here provided by the opposing ends of a split ring 118—which are fixed to the band 108 (as by the loops 120 extending from the band 108 about portions of the ring 118), and about which the grip mount 104 may pivot. The grip mount 104 can be regarded as having an inner mount side 122 (seen in FIGS. 2A-2B) and an opposing outer mount side 124 (seen in FIGS. 1A-1B), with a right mount side 126 (FIGS. 1A and 2A) and an opposing left mount side 128 (FIGS. 1B and 2B) therebetween. Comparing 118 FIGS. 1A and 1B, which show the grip mount 104 and mounting members 114/116 when the grip mount 104 is in the first grip mount position, in conjunction with FIGS. 2A and 2B, which show the grip mount 104 and mounting members 114/116 when the grip mount 104 is in the second grip mount position, it is seen that the mounting members 114/116 extend from the opposing right and left mount sides 126/128 along spaced non-intersecting axes. More specifically, looking to FIG. 1A, when the grip mount 104 is in the first grip mount position, one of the mounting members 114 extends from (and into) the right mount side 126 adjacent to the outer mount side 124, and spaced from the inner mount side 122 (not visible in FIG. 1A), so that the mounting member 114 is pivotally received within the outer and right mount sides 124/126. At the same time, as seen in FIG. 1B, the other mounting member 116 extends from (and into) the left mount side 128 adjacent to the inner mount side 122 (not visible in FIG. 1B), and spaced from the outer mount side 124, so that the mounting member 116 is pivotally received within the inner and left mount sides 122/128. As a result of the offset axes of the mounting members 114/116, their axes travel in orbital paths with respect to each other when the grip mount 104 is pivoted between the first grip mount position (FIGS. 1A-1B) and the second grip mount position (FIGS. 1A-1B), i.e., the axis of the mounting member 114 travels in a path orbiting the axis of the other mounting member 116, and vice versa.

The mounting members 114/116 are elastically mounted with respect to each other to provide a spring force therebetween. When the split ring 118 is used to provide the mounting members, the spring force is provided by the portion of the split ring 118 between the mounting members at its ends, with at least this portion of the split ring 118 being formed of materials which are resiliently flexible (e.g., spring steel or some other material which is flexible, whereby the split ring 118 attempts to flex into a closed state). As a result, the mounting members 114/116 attempt to align into a coaxial state, but cannot since their axes are offset within the grip mount 104. The mounting members 114/116 are nonetheless in their state of lowest stored spring energy—i.e., in their most relieved state—when they are in the first grip mount position (FIGS. 1A-1B) and the second grip mount position (FIGS. 2A-2B), when the split ring 118 assumes a nearly circular shape. As the grip mount 104 is pivoted between these positions, one of the mounting members 114/116 is urged inwardly toward the center of the ring 118, while the other is urged outwardly away from the center of the ring 118, conditions which are resisted by the elastic flexibility of the ring 118. Thus, the mounting members 114/116 are elastically biased to resist pivoting of the grip mount 104 from the first and second grip mount positions, whereby the grip mount 104 is maintained in one of the first and second grip mount positions until urged against the spring force of the ring 118 toward the other of the first and second grip mount positions. The grip mount 104 will therefore (for example) first resist pivoting from the first grip mount position (FIGS. 1A-1B) toward the second grip mount position (FIGS. 2A-2B), but once the grip mount 104 is urged past a point approximately halfway through its arc of rotation—with the grip mount 104 oriented approximately perpendicular to the general plane of the ring 118—it will then be urged by the ring 118 into the second grip mount position. The grip mount 104 and string grip 102 will therefore tend to "snap into" the closer of the first and second grip mount positions and resist resting in an intermediate position (though they can rest, though somewhat precariously, at the halfway point in the arc of rotation of the grip mount 104, when there is an approximate balance in the spring forces urging it toward the first grip mount position and the spring forces urging it toward the second grip mount position).

The bowstring release 100 is therefore seen to provide the advantages of the prior release noted in the foregoing Background section of this document, in that the string grip 102 can be locked into the stowed position (FIGS. 2A-2B), but at the same time it can also be locked into the ready-to-shoot position (FIGS. 1A-1B), and the compact structure achieves both of these results. Additionally, the string grip 102 and grip mount 104 are not "floppy" between the stowed position and the ready-to-shoot position; rather, they are biased into one of these positions rather than freely swinging therebetween. Further, these results are attained in an exceedingly compact and inexpensive mechanism.

Further advantages, features, and objects of the invention will be apparent from the remainder of this document in conjunction with the associated drawings.

BRIEF DESCRIPTION OF THE DRAWINGS

FIG. 1A is a perspective view of the bowstring release 100 with the string grip 102 and grip mount 104 shown in a first (forward or ready-to-fire) position on the mounting band 108.

FIG. 1B is a partial perspective view of the grip mount 104 and the ring 118 of FIG. 1, shown from a different angle.

DETAILED DESCRIPTION OF PREFERRED VERSIONS OF THE INVENTION

Figure 2A:
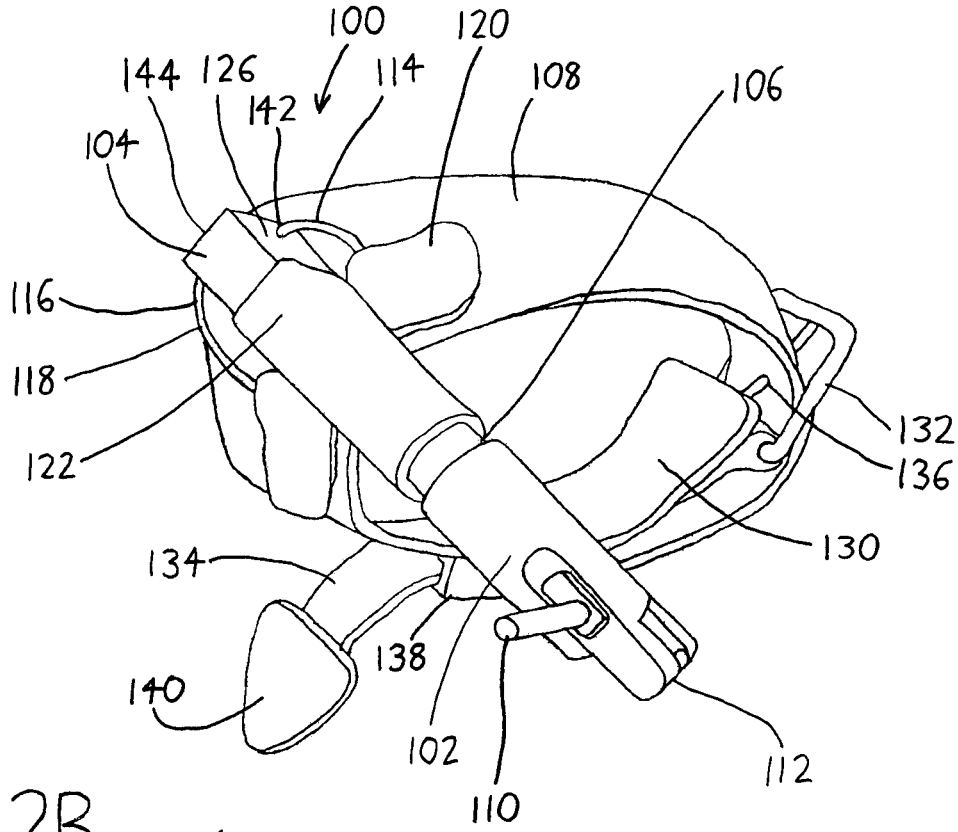
FIG. 2A is a perspective view of the bowstring release 100 with the string grip 102 and grip mount 104 shown in a second (retracted/stowed) position on the mounting band 108.
Figure 2B:
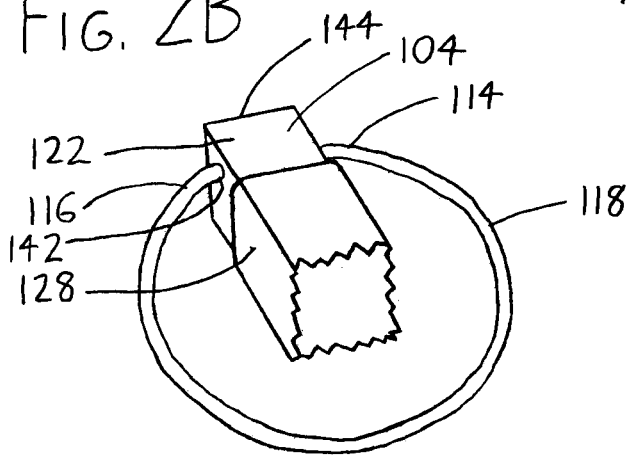
FIG. 2B is a partial perspective view of the grip mount 104 and the ring 118 of FIG. 2, shown from a different angle.

Expanding on the foregoing discussion of the exemplary bowstring release 100, the mounting band 108 is preferably formed of a soft and pliant fabric material allowing it to be readily and comfortably fit about an archer's wrist, with the shape of the mounting band 108 conforming to the contours of the wrist. The mounting band 108 has a generally V-shaped form wherein first and second ends 130 and 134 form the protruding legs of the V, with the bend of the V bearing the loops 120 which engage the ring 118 to the mounting band 108. The first end 130 of the mounting band 108 bears a buckle 132, and the second end 134 extends through the buckle 132 and bears a number of buckle apertures 136 which cooperate with the buckle 132 to allow the first and second ends 130 and 134 of the mounting band to be tightly secured about the wrist. The first band end 130 also bears a U-shaped clip 138 along its length—the opening of the "U" not being shown in FIGS. 1A and 2A—to allow any excess length of the second band end 134 to be retained within the clip 138 against the first band end 130, and preventing such excess length from freely dangling. An enlarged flexible tongue 140 is also situated on the second band end 134 whereby the tongue 140 may be fit through the buckle 132 of the first end 130, but which prevents the second end 134 from easily being pulled entirely through the buckle 132, thereby helping to retain the first and second ends 130 and 134 of the mounting band 108 into a loop form even when the buckle 132 is released.

The ring 118 is preferably formed of a circular loop of spring steel or similar resilient flexible material, with a split being formed in the circumference of the ring 118 to define the mounting members 114 and 116 on the opposite sides of the split. The mounting members 114 and 116 are inserted within offset apertures 142 situated in the opposing right and left mount sides 126 and 128 of the grip mount 104 so that the mounting members 114 and 116 are pivotally received within the mount sides 126 and 128. The apertures 142 are preferably located the same distance from the butt end 144 of the grip mount 104, but one is located within the right mount side 126 adjacent to the outer mount side 124 (to receive mounting member 114), and the other is located within the left mount side 128 adjacent to the inner mount side 122 (to receive mounting member 116). This arrangement is not mandatory, and (for example) the mounting member 114 might instead be received within the right mount side 126 adjacent to the inner mount side 122, and the mounting member 116 might instead be received within the left mount side 128 adjacent to the outer mount side 124. (In this respect, it should be understood that the terms "right" and "left" are relative terms rather than absolute ones—they will depend on an observer's point of view, and such factors as whether the observer wears the bowstring release 100 on his/her right hand or left hand—and these terms should be regarded as interchangeable.) It is also possible that (for example) the apertures 142 for receiving the mounting members 114 and 116 could be equidistant from the right and left mount sides 126 and 128, and could be offset with respect to their distances from the butt end 144 of the grip mount 104 (or that they could be offset in some combination of directions from the right and left mount sides 126 and 128 and butt end 144). However, in these instances, the ring 118 may need to be preloaded so that it biases the grip mount 104 and string grip 102 into the desired first and second grip mount positions.

The grip mount 104 may be simply formed of a length of metal or other material which is capable of withstanding the force of the pulled bowstring. As noted above, the grip mount 104 is preferably connected to the string grip 102 via a rotatable joint 106, thereby allowing the archer to orient the string grip 102 as desired. However, the rotatable joint 106 is not necessary, and the grip mount 104 can merely take the form of an end of the string grip 102.

The string grip 102 depicted in FIGS. 1A and 2A bears a pair of opposing jaws 112 which open when the trigger 110 is actuated. Thus, an archer may pull the trigger 110, insert a bowstring between the jaws 112, and release the trigger 110 to grasp the bowstring, and may subsequently actuate the trigger 110 to release the bowstring.

It should be understood that the bowstring release 100 described above and illustrated in the drawings is merely exemplary, and the mounting band 108, string grip 102, and grip mount 104 may take a wide variety of forms other than those illustrated. Any one or more of the string grip 102, mounting band 108, and grip mount 104 may take the form of grips, bands, and mounts known in the archery industry, including grips, bands, and mounts made by Tru-Fire Corporation (Fond du Lac, Wis.); Scott Archery Manufacturing (Clay City, Ky.); Cobra Manufacturing (Bixby, Okla.); T.R.U. Ball Release (Madison Heights, Va.); and the Allen Company (Broomfield, Colo.), among others. Further, any or all of the string grip 102, mounting band 108, and grip mount 104 may take the form of grips, bands, and mounts known in prior patents, such as U.S. Pat. Nos. 7,240,672 to Peck; 6,925,996 to Todd; 6,763,819 to Eckert; 6,712,060 to Egusquiza; 6,631,709 to Carter et al.; 6,606,984 to Mugg; 6,484,710 to Summers et al.; 6,481,431 to Summers; 6,247,467 to Siegfried; 6,205,991 to Summers et al.; 6,125,833 to Tentler et al.; 6,058,920 to Tentler et al.; 5,941,225 to Tentler et al.; 5,653,213 to Linsmeyer; 5,615,662 to Tentler et al.; and other patents cited in, and citing to, these patents. It is noted that where the term "band" is used, this term is intended to encompass structures that incorporate matter that wraps about a wrist, hand, or other portion of an arm. For example, the mounting band 108 might be provided by a glove whereupon the ring 118, grip mount 104, and string grip 102 are provided, with the mounting band 108 in this case being provided by the structure of the glove which fits about the hand and/or wrist.

The mechanism used to bias the grip mount 104 and string grip 102 into the first and second grip mount positions may also take forms different from the one shown in the exemplary bowstring release 100. As an example, the ring 118 need not have a circular form and could have an oval, square, or other circumference. As another example, a ring 118 need not be used at all, and another arrangement might be used which pivotally affixes the grip mount 104 about offset axes to rotate with respect to the mounting band 108. To illustrate, the grip mount 104 might bear mounting members 114 and 116 having lengths extending along offset axes from the opposing right and left mount sides 126 and 128 to terminate in free ends, with the mounting members 114 and 116 being non-rotatably affixed to the grip mount 104. The free ends of these mounting members 114 and 116 may then be engaged in bearings (e.g., loops similar to loops 120) affixed to the mounting band 108. Alternatively, such offset mounting members 114 and 116 may be affixed to the mounting band 108 and may have free ends pivotally received within the opposing sides 126 and 128 of the grip mount 104.

Still other arrangements which bias the grip mount 104 and string grip 102 into first and second grip mount positions are possible, including arrangements which do not use offset mounting members 114 and 116. For example, the mounting members 114 and 116 may extend into the grip mount 104 along coincident axes, with the mounting members 114 and 116 being pivotally affixed to the mounting band 108 in opposing coaxial bearings affixed to the mounting band 108. The butt end 144 of the grip mount 104 may then be elongated outwardly from the mounting member apertures 142, and may be formed with a rounded end such that it bears against the adjacent surface of the mounting band 108 when rotated between the first and second mount positions of FIGS. 1A and 2A, and such that the bearing force tends to snap the grip mount 104 and string grip 102 into the closer of the first and second grip mount positions. In this case, a flexibly resilient surface, e.g., a flexible metal or plastic plate, might be situated between the opposing bearings for the mounting members 114 and 116 so that the rounded butt end 144 of the grip mount 104 might bear against the surface, with the surface urging the grip mount 104 into the closer of the first and second grip mount positions. Such other versions of the bowstring release are regarded to be part of the invention, but the bowstring release 100 illustrated in the drawings is particularly preferred owing to its low cost, ease of manufacture, limited bulk, and ease of operation.

Preferred versions of the invention have been described above in order to illustrate how to make and use the invention. However, the invention is not limited to these versions, and is intended to be limited only by the claims set out below. Thus, the invention encompasses all different versions that fall literally or equivalently within the scope of these claims.

What is claimed is:

1. A bowstring release including:

a. a string grip adapted to receive and release a bowstring, b. a grip mount attached to the string grip, the grip mount having opposing mount sides;

c. a pair of mounting members wherein:

(1) each mounting member extends from a respective one of the opposing mount sides of the grip mount, (2) the mounting members extend from the opposing mount sides along non-intersecting axes, d. a band suitable for fitting about a limb, wherein the mounting members are fixed to the band.

2. The bowstring release of claim 1 wherein:

a. the grip mount may pivot about the mounting members with respect to the band between first and second grip mount positions;

b. the mounting members are elastically biased to resist pivoting of the grip mount from the first and second grip mount positions, whereby the grip mount is maintained in one of the first and second grip mount positions until urged toward the other of the first and second grip mount positions.

3. The bowstring release of claim 1 wherein:

a. the grip mount has opposing left and right mount sides with opposing inner and outer mount sides therebetween;

b. one of the mounting members extends from the left mount side adjacent to the inner mount side, and is spaced from the outer mount side, and c. the other of the mounting members extends from the right mount side adjacent to the outer mount side, and is spaced from the inner mount side.

4. The bowstring release of claim 3 wherein:

a. the grip mount may pivot about the mounting members with respect to the band, and b. the mounting members are fixed in resiliently flexible relationship with respect to each other to exert a biasing force on the grip mount therebetween, whereby the grip mount is biased to pivot into certain orientations and resist further pivoting therefrom.

5. The bowstring release of claim 1 wherein the mounting members are fixed in resiliently flexible relationship with respect to each other to exert a biasing force on the grip mount therebetween.

6. The bowstring release of claim 1 wherein the mounting members extend within the opposing mount sides of the grip mount.

7. The bowstring release of claim 6 wherein the mounting members are pivotally received within the opposing mount sides of the grip mount.

8. The bowstring release of claim 1 wherein:

a. the mounting members are defined by opposing ring ends of a split ring, and b. the opposing mount sides of the grip mount pivotally receive the opposing ring ends therein.

9. The bowstring release of claim 1 wherein:

a. the mounting members are defined by a split ring, b. the band bears one or more loops thereon, and c. the split ring is retained within the loops to fix the mounting members to the band.

10. A bowstring release including:

a. a string grip, b. a grip mount attached to the string grip, the grip mount having opposing left and right mount sides with opposing inner and outer mount sides therebetween;

c. a pair of mounting members wherein:

(1) one of the mounting members extends from the left mount side adjacent to the inner mount side, and spaced from the outer mount side, and (2) the other of the mounting members extends from the right mount side adjacent to the outer mount side, and spaced from the inner mount side;

wherein the mounting members are elastically mounted with respect to each other to provide a spring force therebetween.

11. The bowstring release of claim 10 wherein:

a. the grip mount may pivot about the mounting members between first and second grip mount positions;

b. the mounting members are elastically biased to resist pivoting of the grip mount from the first and second grip mount positions, whereby the grip mount is maintained in one of the first and second grip mount positions until urged toward the other of the first and second grip mount positions.

12. The bowstring release of claim 10 wherein the mounting members extend from the left mount side and the right mount side along spaced non-intersecting axes.

13. The bowstring release of claim 10 wherein the mounting members extend within the opposing left and right mount sides of the grip mount.

14. The bowstring release of claim 13 wherein the mounting members are pivotally received within the opposing left and right mount sides of the grip mount.

15. The bowstring release of claim 10 wherein:

a. the mounting members are defined by opposing ring ends of a split ring, and b. the opposing left and right mount sides of the grip mount pivotally receive the opposing ring ends therein.

16. The bowstring release of claim 10 wherein:

a. the bowstring release further includes a band suitable for fitting about a limb;

b. the mounting members are defined by a split ring, c. the band bears one or more loops thereon, and d. the split ring is retained within the loops.

17. A bowstring release including:

a. a band suitable for fitting about a limb;

b. a grip mount;

c. a pair of resiliently flexible mounting members extending between the band and the grip mount, wherein:

(1) the grip mount may pivot about the mounting members with respect to the band between first and second grip mount positions;

(2) the mounting members being biased to resist pivoting of the grip mount from the first and second grip mount positions, whereby the grip mount is maintained in one of the first and second grip mount positions until urged toward the other of the first and second grip mount positions.

18. The bowstring release of claim 17 wherein:

a. the mounting member has opposing mount sides from which the mounting members extend, with each mounting member extending from a respective one of the opposing mount sides; and b. the mounting members extend from the opposing mount sides along non-intersecting axes.

19. The bowstring release of claim 18 wherein each mounting member is pivotally received within the mount side from which it extends.

20. The bowstring release of claim 17 wherein:

a. the mounting member has opposing mount sides from which the mounting members extend, with each mounting member extending from a respective one of the opposing mount sides; and b. the mounting members are defined by opposing ring ends of a split ring.

21. The bowstring release of claim 20 wherein the opposing mount sides pivotally receive the opposing ring ends therein.

22. The bowstring release of claim 17 wherein:

a. the mounting member has opposing left and right mount sides with opposing inner and outer mount sides therebetween;

b. one of the mounting members extends from the left mount side adjacent to the inner mount side, and spaced from the outer mount side, and c. the other of the mounting members extends from the right mount side adjacent to the outer mount side, and spaced from the inner mount side.

23. The bowstring release of claim 17 wherein the mounting members have axes which travel in orbital paths with respect to each other when the grip mount is pivoted between the first and second grip mount positions.

24. The bowstring release of claim 17 wherein:

a. the mounting members are defined by a split ring, b. the band bears one or more loops thereon, and c. the split ring is retained within the loops.

25. A bowstring release including:

a. a band suitable for fitting about a limb;

b. a string grip adapted to receive and release a bowstring, c. a grip mount:

(1) connected to the string grip, and (2) being pivotally connected to the band, wherein the grip mount is elastically biased into:

(a) a first grip mount position, and (b) a second grip mount position oriented differently from the first grip mount position, whereby the grip mount, when urged out of one of the grip mount positions, is elastically biased toward the closer of the grip mount positions.

* * * * *